US009989230B2

(12) United States Patent
Yamamoto

(10) Patent No.: US 9,989,230 B2
(45) Date of Patent: Jun. 5, 2018

(54) BALLOON-TYPE ILLUMINATION DEVICE AND PROJECTOR

(71) Applicant: LIGHT BOY CO., LTD., Inagi, Tokyo (JP)

(72) Inventor: Kikuo Yamamoto, Inagi (JP)

(73) Assignee: LIGHT BOY CO., LTD., Inagi-Shi, Tokyo (JP)

( * ) Notice: Subject to any disclaimer, the term of this patent is extended or adjusted under 35 U.S.C. 154(b) by 290 days.

(21) Appl. No.: 14/787,218

(22) PCT Filed: Jan. 28, 2014

(86) PCT No.: PCT/JP2014/051747
§ 371 (c)(1),
(2) Date: Oct. 26, 2015

(87) PCT Pub. No.: WO2015/008499
PCT Pub. Date: Jan. 22, 2015

(65) Prior Publication Data

US 2016/0069552 A1 Mar. 10, 2016

(30) Foreign Application Priority Data

Jul. 19, 2013 (JP) ..... 2013-150828

(51) Int. Cl.
*F21V 21/00* (2006.01)
*F21V 23/02* (2006.01)
(Continued)

(52) U.S. Cl.
CPC ..... *F21V 23/026* (2013.01); *F21L 13/00* (2013.01); *F21V 3/026* (2013.01); *F21V 15/02* (2013.01);
(Continued)

(58) Field of Classification Search
CPC .. F21V 23/0261; F21V 23/0442; F21V 3/026; F21V 15/02; F21V 25/00
See application file for complete search history.

(56) References Cited

U.S. PATENT DOCUMENTS

2004/0170022 A1 9/2004 Yoshimori et al.
2005/0063189 A1* 3/2005 Ossolinski ..... B60P 3/18 362/363

FOREIGN PATENT DOCUMENTS

EP 1403580 A1 3/2004
JP 3088154 U 8/2002
(Continued)

OTHER PUBLICATIONS

Communication under Rule 71(3) EPC for European Patent Application No. 14826067.2 (dated Mar. 8, 2017).

*Primary Examiner* — Anabel Ton
(74) *Attorney, Agent, or Firm* — Rabin & Berdo, P.C.

(57) ABSTRACT

The present invention simplifies the system of power lines from the power source of a balloon-type illumination device to the inside of the balloon. The balloon-type illumination device (1) is provided with: a balloon (2); a discharge lamp (3) provided within the balloon (2); a blower (4) that is provided within the balloon (2) and inflates the balloon (2); a ballast (5) that performs stabilized power supply to the discharge lamp (3) and is provided outside the balloon (2); and a power source circuit (6) that is provided within the balloon (2) and is for sending, to the blower (4), a portion of the power to be supplied to the discharge lamp (3).

15 Claims, 4 Drawing Sheets

(51) Int. Cl.

| | |
|---|---|
| ***F21L 13/00*** | (2006.01) |
| ***F21V 3/02*** | (2006.01) |
| ***F21V 15/02*** | (2006.01) |
| ***F21V 25/00*** | (2006.01) |
| *F21V 23/04* | (2006.01) |
| *F21V 23/06* | (2006.01) |
| *F21V 21/22* | (2006.01) |
| *F21W 131/10* | (2006.01) |
| *F21Y 113/00* | (2016.01) |
| *F21V 21/10* | (2006.01) |

(52) U.S. Cl.

CPC ..... *F21V 23/0442* (2013.01); *F21V 25/00* (2013.01); *F21V 21/10* (2013.01); *F21V 21/22* (2013.01); *F21V 23/04* (2013.01); *F21V 23/06* (2013.01); *F21W 2131/1005* (2013.01); *F21Y 2113/00* (2013.01)

(56) References Cited

FOREIGN PATENT DOCUMENTS

| | | | |
|---|---|---|---|
| JP | 2003-36709 | A | 2/2003 |
| JP | 2007-305506 | A | 11/2007 |
| JP | 2009-081011 | A | 4/2009 |
| JP | 2012-230829 | A | 11/2012 |

* cited by examiner

BALLOON-TYPE ILLUMINATION DEVICE AND PROJECTOR

TECHNICAL FIELD

The present invention relates to a balloon-type illumination device and a projector.

BACKGROUND ART

Because of superiorities in that, for example, an omnidirectional wide illumination range is obtained and high antiglare effects are obtained, there are increasing demands for a balloon-type illumination device not only as projectors used in outdoor illumination in a construction site and the like but also as illumination devices for both outdoor and indoor various uses.

The conventional balloon-type illumination device includes a balloon that can inflate with the air pressure. A light source and a blower for inflating the balloon are disposed on the inside of the balloon.

As the light source of the balloon-type illumination device, in general, a discharge lamp such as an HID lamp is used. Electric power supplied from a generator or a commercial power supply is supplied to the discharge lamp via a ballast.

The ballast stabilizes the power supply power before supplying the same to the discharge lamp. A ballast called copper iron ballast mainly configured from a choke coil obtained by winding a copper wire around an iron core and a ballast called electronic ballast obtained by converting the copper iron ballast into an electronic form using an inverter and a thyristor control circuit are used.

The conventional balloon-type illumination device includes a holding part in the center of the balloon. The discharge lamp, the blower, and the ballast are disposed in the holding part on the inside of the balloon (see Patent Document 1 below).

RELATED ART LITERATURE

Patent Document

Patent Document 1: Japanese Patent Application Laid-Open No. 2009-81011

SUMMARY OF THE INVENTION

Technical Problem

As in the related art explained above, in the balloon-type illumination device in which the ballast is disposed on the inside of the balloon, a power line extending from the power supply such as the generator branches on the inside of the balloon to be connected to the ballast and the blower.

Such a related art does not cause a problem in a balloon-type illumination device in which a lamp is a single light type. However, in a large balloon-type illumination device including a plurality of lamps, a plurality of ballasts having large weight is disposed on the inside of a balloon. The weight of a balloon portion increases. Therefore, when the balloon-type illumination device is set on an extendable column part and used as the projector, a problem occurs in that operability of extension and retraction and lifting and lowering of the column part is deteriorated. Further, since the heavy balloon portion is placed in a high position on the column part, a problem also occurs in terms of installation stability and safety.

To solve the problems, it is conceivable to provide the heavy ballast on the outside of the balloon and hold the ballast with a lower part of the column part or a base that supports the column part.

However, when the ballast is provided on the outside of the balloon and held, in order to prevent the ballast from adversely affecting constant power-controlled electric power output from the ballast, a power line extending from the power supply to the inside of the balloon is divided, on the outside of the balloon, into two systems of a power line leading to a plurality of lamps in the balloon via a plurality of ballasts and a power line leading to the blower in the balloon from the power supply.

When the power line from the power supply is divided, on the outside of the balloon, into the system leading to the lamp and the system leading to the blower in this way, when an energization deficiency such as disconnection or a connection failure occurs in the power line on the blower side, the lamp is sometimes lit in a state in which the balloon does not inflate. When such a situation occurs, there is concern that the temperature in the balloon rises, a deficiency occurs in the lamp and the like, and the balloon itself is heated and damaged.

When the power line from the power supply is divided, on the outside of the balloon, into the system leading to the lamp and the system leading to the blower, the number of wires of the power line increases, and not only an exterior is deteriorated but also handling of the wires during extension and retraction of the column part is deteriorated when the balloon-type illumination device is used as a projector. When it is attempted to solve the problem using a multi-core cable, there is a problem in that the multi-core cable itself increases in thickness, weight, and cost.

In recent years, it has been admitted that a balloon-type projector is superior compared with an irradiation projector in terms of an irradiation range, antiglare effects, and the like of the projector. There is a demand for changing the existing irradiation projector to the balloon-type projector according to uses.

In this case, in many irradiation projectors including a plurality of lamps, a plurality of ballasts is held by a lower part of a column part or a base. A power line for connection to a blower in a balloon needs to be provided anew in addition to connection of a power line for connecting the ballasts and the plurality of lamps in the balloon. Therefore, there is a problem in that the irradiation projector cannot be easily changed to the balloon-type projector.

An example of an object of the present invention is to cope with such problems. That is, it is an object of the present invention to, for example, simplify a system of a power line leading to the inside of a balloon from a power supply for supplying electric power to a balloon-type illumination device, avoid, through the simplification of the power line, a deficiency in that, in a state in which the balloon does not inflate, a lamp is lit, and make it possible to easily perform handling and connection of wires, and moreover make it possible to easily change an irradiation projector to a balloon-type projector.

Solution to Problems

In order to attain such objects, the present invention includes at least configurations explained below.

A balloon-type illumination device including: a balloon; a discharge lamp disposed inside the balloon; a blower disposed in the balloon and configured to inflate the balloon; a ballast disposed outside the balloon and configured to perform stable power supply to the discharge lamp; and a power supply circuit disposed inside of the balloon and for feeding, to the blower, a part of electric power to be supplied to the discharge lamp.

Advantageous Effects of the Invention

In the balloon-type illumination device having such a characteristic or a projector including the balloon-type illumination device, the ballast is disposed outside the balloon. Therefore, it is possible to reduce the weight of a balloon portion. When the balloon is supported at the top of a column part, extension/contraction operability of the column part is satisfactory. It is possible to secure installation stability and safety of the projector.

The balloon-type illumination device includes, on the inside the balloon, the power supply circuit for feeding, to the blower, a part of the electric power to be supplied to the discharge lamp. Therefore, a power feeding system leading to the inside of the balloon from a power supply is constituted as a single power feeding system leading to the discharge lamp from the ballast. It is possible to avoid, as much as possible, a situation in which power feeding to the discharge lamp is performed, although the power supply to the blower is cut off.

Consequently, it is possible to avoid a deficiency in that the discharge lamp is lit in a state in which the balloon does not inflate.

Since the power feeding system leading to the inside of the balloon from the power supply is constituted as a single power feeding system leading to the discharge lamp from the ballast, it is possible to simplify handling and connection of wires by, for example, collecting the power feeding system as one cable. Even when an irradiation projector is changed to a balloon-type projector, the power feeding system leading to the discharge lamp from the ballast only has to be replaced. Therefore, it is possible to easily perform the change.

DESCRIPTION OF EMBODIMENTS

An embodiment of the present invention is explained below with reference to the drawings.

Figure 1:
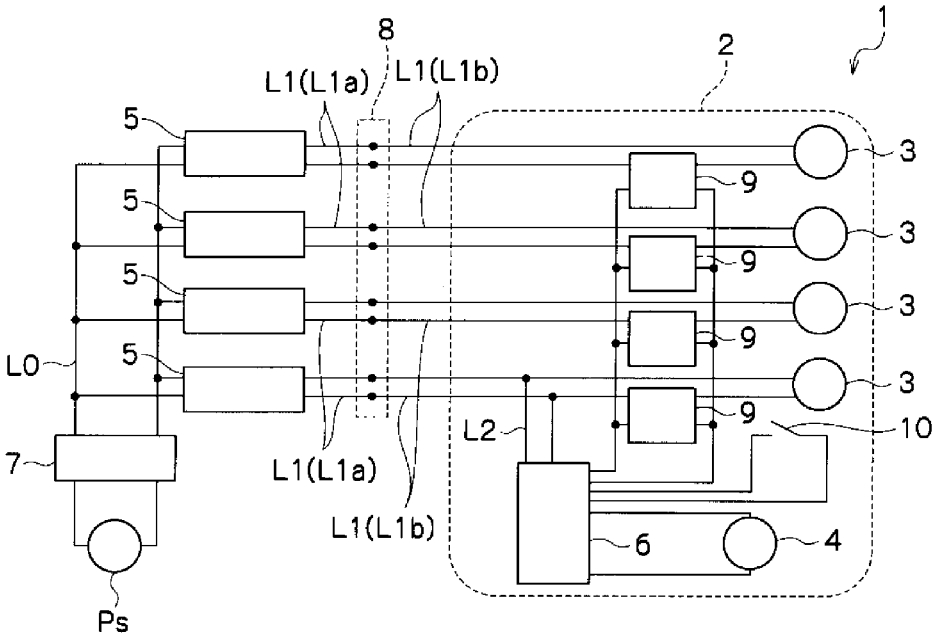
FIG. 1 is an explanatory diagram showing the configuration of a balloon-type illumination device according to an embodiment of the present invention.

FIG. 1 is an explanatory diagram showing the configuration of a balloon-type illumination device according to an embodiment of the present invention.

A balloon-type illumination device 1 includes a balloon 2, discharge lamps 3 disposed on the inside of the balloon 2, a blower 4 disposed in the balloon 2 and configured to inflate the balloon 2, ballasts 5 disposed outside the balloon 2 and configured to perform stable power supply to the discharge lamps 3, and a power supply circuit 6 disposed on the inside of the balloon 2 and for feeding, to the blower 4, a part of electric power to be supplied to the discharge lamps 3.

The balloon 2 is a bag-like member that changes to an inflated state when the air pressure is applied to the inside and changes to a deflated state when the air pressure on the inside is removed. The balloon 2 can discharge light, which is emitted from the discharge lamps 3 disposed on the inside, to an irradiation range around the balloon 2 in a diffused state.

The discharge lamps 3 are illumination light sources of the balloon-type illumination device 1. For example, an HID lamp can be used.

The discharge lamps 3 are disposed in a holding part that holds the balloon 2 in the center of the balloon 2.

In the example shown in the figure, a plurality of (as an example, four) discharge lamps 3 is disposed on the inside of the balloon 2.

The blower 4 is a blower that sends wind to the inside of the balloon 2. During lighting of the discharge lamps 3, the blower 4 is always operated to keep the balloon 2 in the inflated state.

The ballasts 5 disposed outside the balloon 2 are ballasts for supplying, in a stable state, to the discharge lamps 3, electric power supplied by a power supply Ps configured by a generator, a commercial power supply, or the like. For example, constant power-controlled electric power is output from the ballasts 5.

A main switch 7 is provided in a power line L0 leading to the ballasts 5 from a power supply Ps. By turning on and off the main switch 7, it is possible to simultaneously perform actuation and stop of the discharge lamps 3 and the blower 4.

The power supply circuit 6 disposed on the inside of the balloon 2 is connected to a power line L2 branching from a power line L1 leading to the discharge lamp 3 from the ballast 5. The power supply circuit 6 feeds, to the blower 4, a part of electric power to be supplied to the discharge lamp 3.

In the example shown in the figure, the power supply circuit 6 is connected to the power line L2 branching from one of a plurality of power lines L1. However, the power line L2 may branch from two or more power lines L1.

In the example shown in the figure, a plurality of ballasts 5 is disposed to respectively correspond to a plurality of discharge lamps 3.

A plurality of power lines leading to each of the discharge lamps from each of the plurality of ballasts 5 can be collected as one cable. A connector 8 for connecting and separating the plurality of power lines L1 can be disposed halfway in the cable.

The connector 8 can simultaneously connect and separate wires L1*a* on the ballast side and wires L1*b* on the discharge lamp 3 side among the provided plurality of power lines L1.

In the balloon-type illumination device 1 including such a configuration, the weight of the balloon portion can be reduced by disposing the ballasts 5 outside the balloon 2.

The power line leading to the inside of the balloon 2 from the power supply Ps can be one system of the power lines L0 and L1 for feeding electric power to the discharge lamps 3 via the ballasts 5 and it is unnecessary to provide another power line for supplying electric power to the blower 4.

As explained above, a plurality of power lines L1 can be collected as one cable to manage connection and division of the power lines L1. Therefore, it is possible to suppress occurrence of a deficiency in that the discharge lamps 3 are lit in a state in which power feeding to the blower 4 is cut off.

Since it is possible to simplify wires of the power lines, it is possible to easily perform handling and connection of the wires.

In the embodiment of the balloon-type illumination device 1 shown in FIG. 1, components for further improving safety are added.

That is, in this embodiment, the balloon-type illumination device 1 includes switch parts 9 disposed in the balloon 2 and configured to energize and cut off the power lines L1 leading to the discharge lamps 3 from the ballasts 5 and a sensor part 10 disposed in the balloon 2 and configured to sense a deflated state of the balloon 2. The power supply circuit 6 includes a drive control function for cutting off the switch parts 9 when the sensor part 10 senses the deflated state of the balloon 2.

By adding such components, it is possible to actively suppress a deficiency in that the discharge lamps 3 are lit in a state in which power feeding to the blower 4 is cut off.

Figure 2:
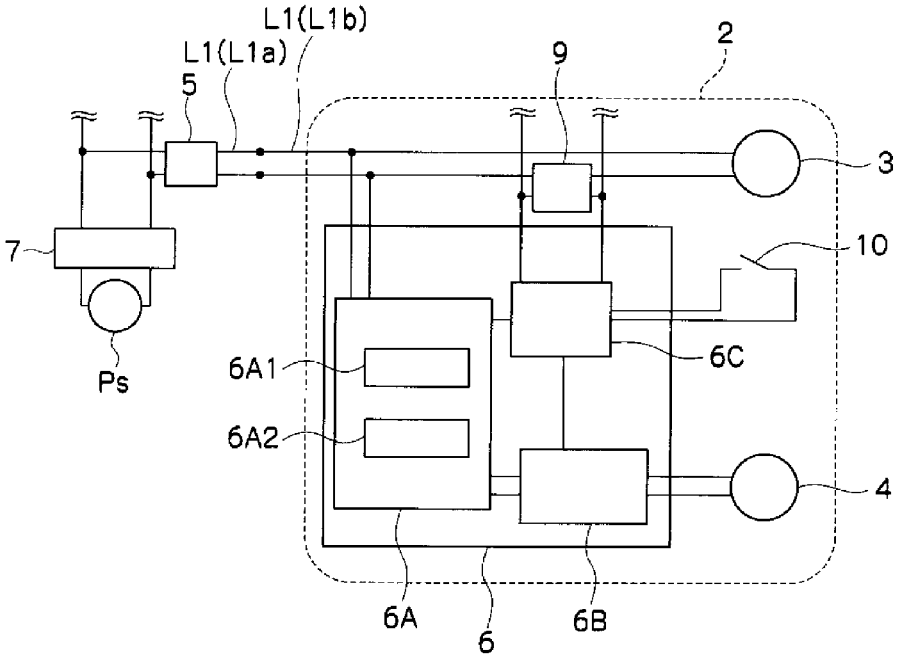
FIG. 2 is an explanatory diagram showing the functional configuration of a power supply circuit in the balloon-type illumination device according to the embodiment of the present invention.

FIG. 2 is an explanatory diagram showing the functional configuration of the power supply circuit explained above (portions common to the components explained above are denoted by the same reference numerals and signs and redundant explanation of the parts is explained).

As shown in the figure, the power supply circuit 6 includes an input control circuit part 6A, a blower power supply circuit part 6B, and a safety control circuit part 6C.

As explained above, the power supply circuit 6 is a circuit branching from the power line L1, which supplies electric power stabilized by the ballast 5 to the discharge lamp 3, to supply the electric power to the blower 4.

In general, an output of the ballast 5 is set to have a margin of 5% or more compared with rated power consumption of the discharge lamp 3 (e.g., an HID lamp). Therefore, it is not a problem in terms of electric capacity to divide electric power of approximately several percent as electric power for driving of the blower 4 from the output of the ballast 5.

However, if the output of the ballast 5 is simply divided as electric power for driving the blower, it is conceivable that stable lighting of the discharge lamp 3 is adversely affected.

Therefore, the power supply circuit 6 in the embodiment of the present invention has a function of not disturbing constant power control performed in power supply from the ballast 5 to the discharge lamp 3. Consequently, the power supply circuit 6 prevents die-out (a phenomenon in which a lamp is suddenly extinguished) of the discharge lamp 3, a flickering phenomenon in illumination light irradiated by the discharge lamp 3, and the like from occurring.

Specifically, an input control circuit part 6A in the power supply circuit 6 includes a power factor improving function part (a PFC circuit part) 6A1 and an overcurrent suppressing function part 6A2.

The power factor improving function part 6A1 always extracts electric power following and proportional to a drive voltage of the discharge lamp 3 not to disturb the constant power control for the discharge lamp 3.

The overcurrent suppressing function part 6A2 suppresses the power supply circuit 6 from directly supplementing a rush current that usually flows during a driving start of the blower 4. The overcurrent suppressing function part 6A2 suppresses a temporary overcurrent from flowing to the blower 4 side to disturb the constant power control for the discharge lamp 3.

The blower power supply circuit part 6B of the power supply circuit 6 outputs, as electric power for the blower 4, an input from the input control circuit part 6A explained above.

Like the blower power supply circuit part 6B, the safety control circuit part 6C of the power supply circuit 6 is driven by the electric power from the input control circuit part 6A. The safety control circuit part 6C controls the switch part (a relay switch, etc.) 9 to open not to light the discharge lamp 3 while the sensor part 10 senses the deflated state of the balloon 2.

The sensor part 10 may be a contact sensor that detects contact with the balloon 2. When the contact sensor is pressed in the deflated state of the balloon 2, the safety control circuit part 6C may control the switch part 9 to open. The sensor part 10 may be a temperature sensor that detects the temperature in the balloon 2. When the temperature sensor detects that the temperature in the balloon 2 rises to be equal to or higher than a set temperature, the safety control circuit part 6C may control the switch part 9 to open.

Note that, in the example shown in FIG. 2, both of the blower power supply circuit part 6B and the safety control circuit part 6C receive electric power from one power line L1 for the discharge lamp 3 via the input control circuit part 6A. However, not only this, but the blower power supply circuit part 6B and the safety control circuit part 6C may respectively receive electric power from separate power lines L1. Alternatively, each of the blower power supply circuit part 6B and the safety control circuit part 6C may receive electric power from a plurality of power lines L1.

Figure 3:
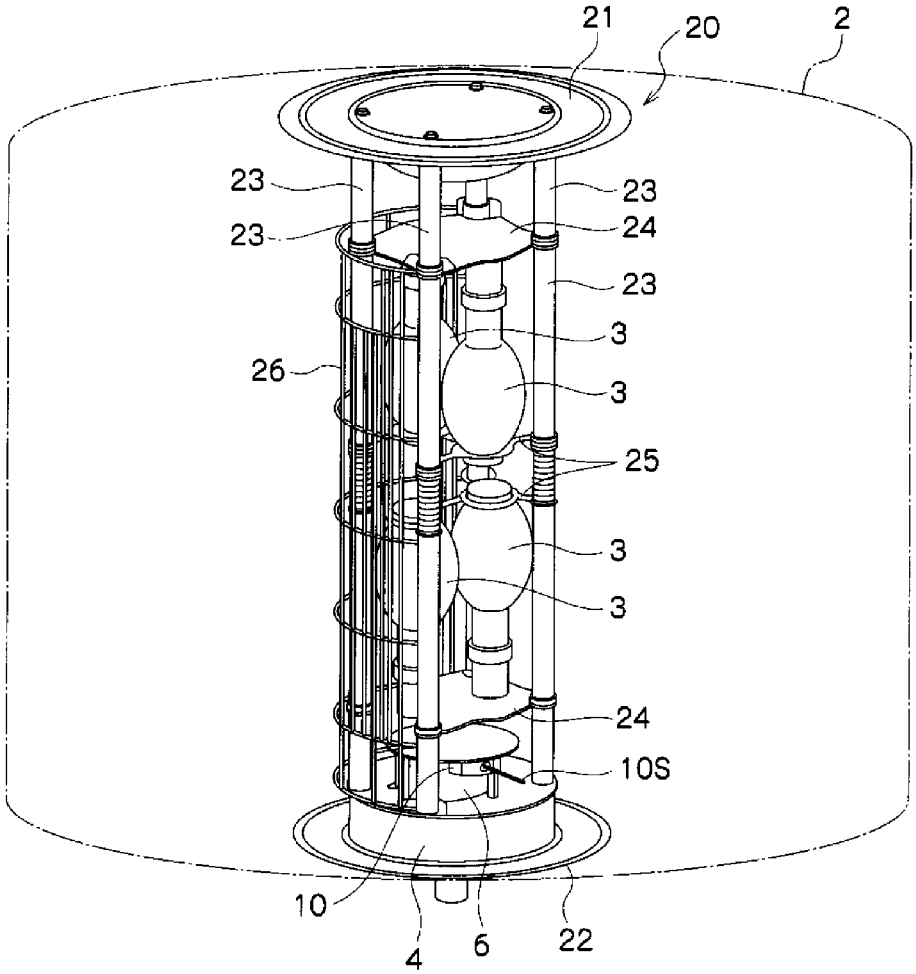
FIG. 3 is an explanatory diagram showing a specific configuration example of the inside of a balloon in the balloon-type illumination device according to the embodiment of the present invention.

FIG. 3 is an explanatory diagram showing a specific configuration example of the inside of the balloon in the balloon-type illumination device according to the embodiment of the present invention.

A holding part 20 is attached along the center axis of the balloon 2 on the inside of the balloon 2.

The holding part 20 includes an upper holding body 21 that holds the upper center of the balloon 2 and a lower holding body 22 that holds the lower center of the balloon 2. A plurality of pillar bodies 23 is provided between the upper holding body 21 and the lower holding body 22. The interval between the upper holding body 21 and the lower holding body 22 is kept.

The blower 4 is disposed in the lower holding body 22.

The blower 4 sends the air on the outer side of the lower holding body 22 to the inner side of the balloon 2 to inflate the balloon 2.

A circuit part such as the power supply circuit 6 is disposed on the blower 4.

Lamp socket parts 24 are respectively attached to an upper part and a lower part of the pillar bodies 23. Two discharge lamps 3 are connected to each of the lamp socket parts 24.

The discharge lamps 3 are disposed with heads thereof respectively directed to the centers in spaces on the inner sides of the pillar bodies 23. The heads of the discharge lamps 3 are held to the pillar bodies 23 by lamp-holding bodies 25.

The outer sides of the pillar bodies 23 are covered with a protection frame body 26.

In such a holding part 20, the sensor part 10 is disposed in a space on the lower holding body 22 on which the power supply circuit 6 is disposed.

The sensor part 10 is a contact sensor from which a contactor 10S is projected to the outer sides of the pillar bodies 23. When the balloon 2 changes to the deflated state, the inner side of the balloon 2 comes into contact with the contactor 10S, whereby the sensor part 10 is actuated.

Figure 4:
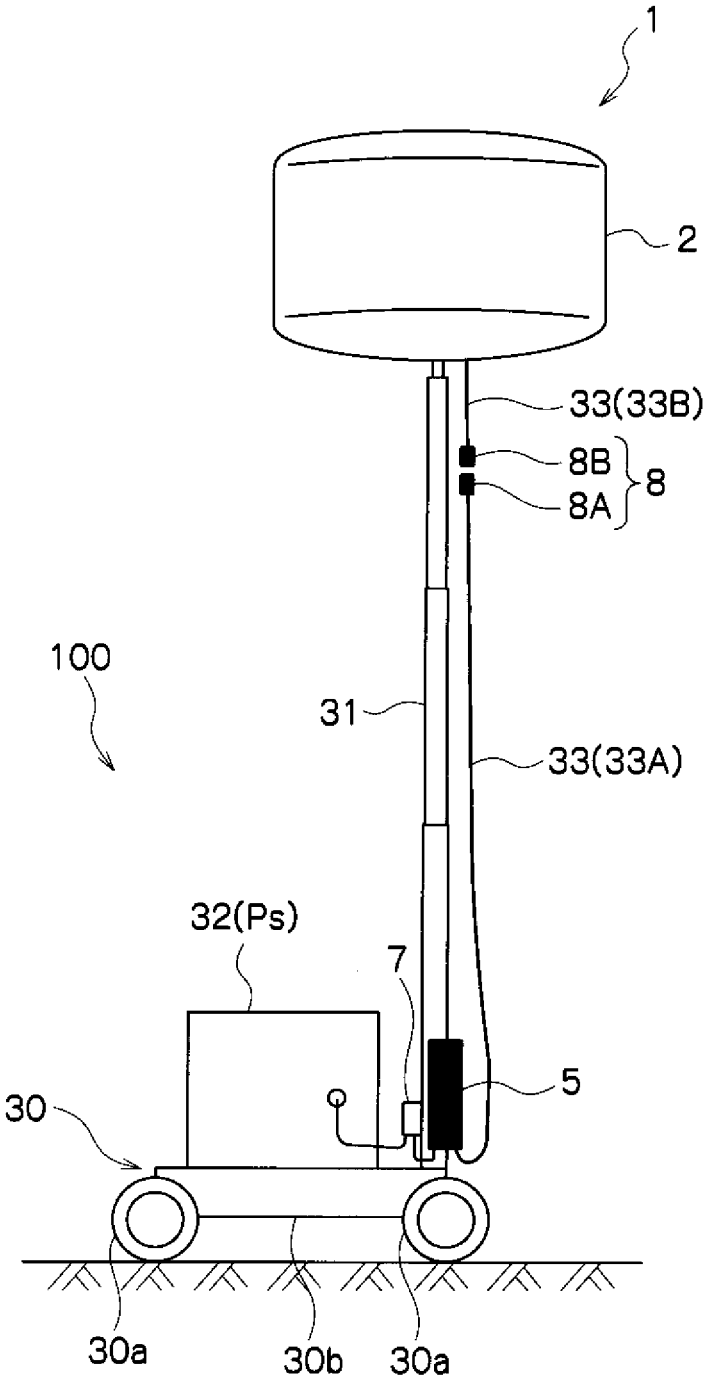
FIG. 4 is an explanatory diagram showing a projector including the balloon-type illumination device according to the embodiment of the present invention.

FIG. 4 is an explanatory diagram showing a projector including the balloon-type illumination device according to the embodiment of the present invention (parts same as the parts explained above are denoted by the same reference numerals and signs and redundant explanation of the parts is omitted).

A projector 100 including the balloon-type illumination device 1 explained above includes a grounding part 30 and a column part 31 vertically supported to the grounding part 30. The ballast 5 is supported at a lower part of the column part 31 or the grounding part 30. The balloon 2 is supported at the top of the column part 31.

An example is shown in which the grounding part 30 shown in the figure includes casters 30*a* and a base 30*b* and a generator 32 functioning as the power supply Ps is mounted on the base 30*b*. However, not only this, but the grounding part 30 may be a grounding part configured by a leg part such as a tripod. As the power supply Ps, a commercial power supply or a battery may be used.

The column part 31 may be an extendable column part or may be a column part having fixed length.

In the example shown in FIG. 4, the power lines L1 extending from the ballast 5 into the balloon 2 are collected as one cable 33. The connector 8 for connecting and separating the plurality of power lines L1 is disposed halfway in the cable 33. Connector terminals 8A and 8B of the connector 8 are connected, whereby a cable 33A on the ballast 5 side and a cable 33B on the balloon 2 side are connected. In such a projector 100, the discharge lamps 3 and the blower 4 in the balloon 2 can be driven by electricity supply via one cable 33. It is possible to easily perform handling and connection and separation of wires.

Since the ballast 5 is disposed outside the balloon 2, a balloon portion at the top of the column part 31 is light in weight. Operability such as extension and retraction of the column part 31 is satisfactory. It is possible to secure installation stability and safety.

Figure 5B:
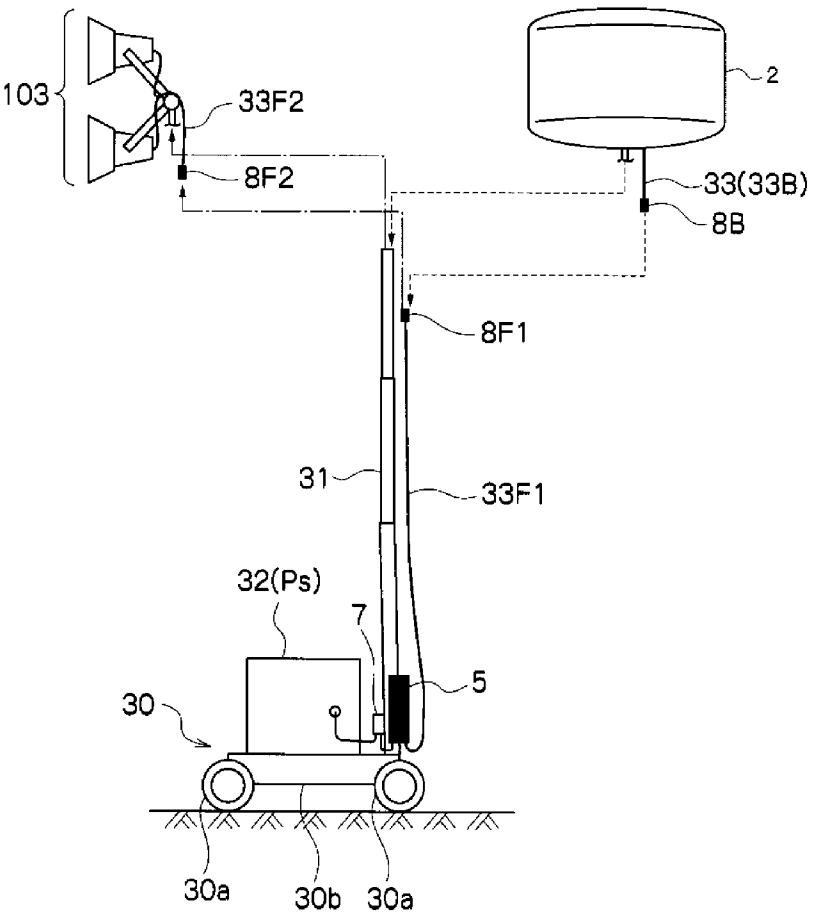
FIG. 5 is an explanatory diagram showing a procedure in changing an irradiation projector to a balloon-type projector ((a) shows an exterior example of the irradiation projector and (b) shows a replacement procedure for an illumination device).
Figure 5A:
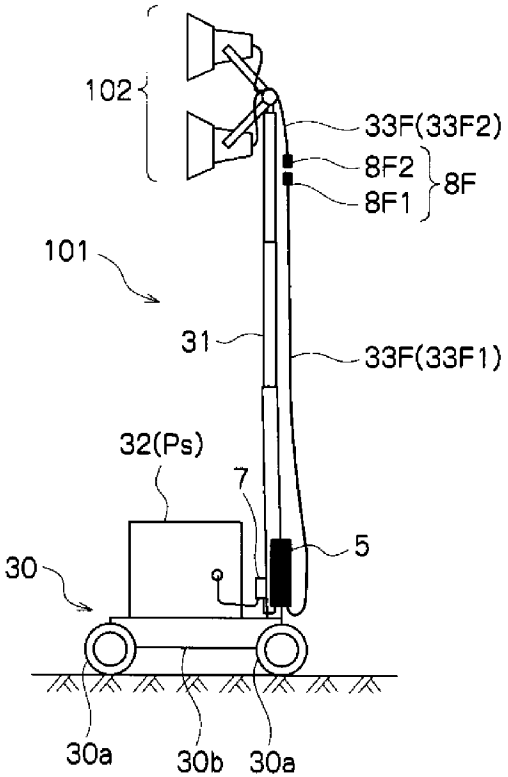

FIG. 5 is an explanatory diagram showing a procedure in changing an irradiation projector to a balloon-type projector.

In FIG. 5(*a*), an exterior example of the irradiation projector is shown.

Like the balloon-type projector 100, an irradiation projector 101 shown in the figure includes the grounding part 30 and the column part 31. The generator 32 is mounted on the base 30*b* of the grounding part 30.

An irradiation illumination device 102 is supported at the top of the column part 31. The ballast 5 for supplying stable electric power to the irradiation illumination device 102 is disposed in the grounding part 30 or in a lower part of the column part 31. Power lines for supplying electric power, which is output from the ballast 5, to the irradiation illumination device 102 are collected by a cable 33F. A connector 8F is disposed halfway in the cable 33F A connector terminals 8F1 and 8F2 of the connector 8F are connected, whereby a cable 33F1 on the ballast 5 side and a cable 33F2 on the irradiation illumination device 102 side are connected.

To change such an irradiation projector 101 to the balloon-type projector 100, as shown in FIG. 5(*b*), first, the connector 8F of the irradiation projector 101 is separated to detach the irradiation illumination device 102 from the top of the column part 31.

Simply by connecting a connector terminal 8B of the balloon-type illumination device 1 to the connector terminal 8F1 of the separated connector 8F and attaching the balloon 2 to the top of the column part 31, it is possible to obtain a balloon-type projector.

In this case, electrical components such as the ballast 5, the main switch 7, the cable 33F1, and the generator 32 in the irradiation projector 101 and components such as the grounding part 30 and the column part 31 can be used as they are even after the change to the balloon-type projector.

In this case, when the cable 33F of the irradiation projector 101 does not include the connector 8F, simply by cutting the cable 33F in an appropriate position and connecting an end of the cut cable 33F and an end of the cable 33B of the balloon-type illumination device 1 using general-purpose connecting means including a compression bonding terminal, it is possible to easily change the irradiation projector 101 to a balloon-type projector.

In this case, electricity supply to the blower included in the balloon-type illumination device 1 does not have to be considered at all in a process of the change. Therefore, it is possible to quickly and easily end changing work.

As explained above, the balloon-type illumination device 1 and the projector 100 including the balloon-type illumination device 1 according to the embodiment of the present invention include, in the balloon 2, the power supply circuit 6 for feeding, to the blower 4, a part of electric power to be supplied to the discharge lamp 3. Therefore, it is possible to simplify the power lines L0 and L1 leading to the inside of the balloon 2 from the power supply Ps as one system for supplying electric power to the discharge lamp 3.

Consequently, it is possible to avoid, as much as possible, a deficiency in that the discharge lamp 3 is lit in a state in which the power lines for supplying electric power to the blower is cut off alone and the balloon 2 does not inflate.

It is possible to easily perform handling and connection of wires through simplification of the power lines L0 and L1 leading to the inside of the balloon 2 from the power supply Ps.

When the irradiation projector 101 is changed to the balloon-type projector 100 as well, it is possible to change an electric system simply by connecting the cable 33F, in which the power lines of the irradiation projector 101 are collected, to the cable 33, in which the power lines L1 of the balloon-type illumination device 1 are collected. It is unnecessary to perform power supply to the blower 4 through another wire. Therefore, it is possible to quickly and easily perform changing work.

The ballast 5 is disposed on the outer side of the balloon 2 to attain a reduction in the weight of the balloon portion. Therefore, in a large balloon-type illumination device including a plurality of discharge lamps 3 as well, when the balloon-type illumination device is used in the projector 100 supported on the column part 31, it is possible to make it easy to perform extension and contraction operation of the column part and secure installation stability and safety.

The embodiments of the present invention are explained in detail above with reference to the drawings. However, a specific configuration is not limited to the embodiments. Changes and the like of design in a range not departing from the spirit of the present invention are included in the present invention.

Unless there are contradiction and problems in the objects, the configurations, and the like in particular in the embodiments explained above, the techniques of the embodiments can be applied to each other and combined.

REFERENCE SIGNS LIST

1: Balloon-type illumination device, 2: Balloon, 3: Discharge lamp, 4: Blower,
5: Ballasts, 6: Power supply circuit,
6A: Input control circuit part, 6A1: Power factor improving function part, 6A2: Overcurrent suppressing function part,
6B: Blower power supply circuit part, 6C: Safety control circuit part,
7: Main switch, 8: Connector
9: Switch part, 10: Sensor part, 10S: Contactor,
20: Holding part, 21: Upper holding body, 22: Lower holding body, 23: Pillar body,
24: Lamp socket part, 25: Lamp-holding body, 26: Protection frame body,
30: Grounding part, 31: Column part, 32: Generator, 33: Cable
Ps: Power supply, L0, L1, L2: Power line

What is claimed is:

1. A balloon-type illumination device comprising:
a balloon;
a discharge lamp disposed inside the balloon;
a blower disposed in the balloon and configured to inflate the balloon;
a ballast disposed outside the balloon and configured to perform stable power supply to the discharge lamp; and
a power supply circuit disposed inside of the balloon and feeding, to the blower, a part of electric power to be supplied to the discharge lamp, wherein
the power supply circuit is connected to a power line branching from a power line leading to the discharge lamp from the ballast,
a plurality of the discharge lamps is disposed in the balloon,
a plurality of the ballasts is disposed corresponding to each of discharge lamps, and
a plurality of power lines leading to each of the discharge lamps from each of the ballasts is collected as one cable, and a connector for connecting and separating the plurality of power lines is disposed halfway in the cable.

2. A balloon-type illumination device, comprising:
a balloon;
a discharge lamp disposed inside the balloon;
a blower disposed in the balloon and configured to inflate the balloon;
a ballast disposed outside the balloon and configured to perform stable power supply to the discharge lamp; and
a power supply circuit disposed inside of the balloon and feeding, to the blower, a part of electric power to be supplied to the discharge lamp, wherein
the power supply circuit is connected to a power line branching from a power line leading to the discharge lamp from the ballast,
a plurality of the discharge lamps is disposed in the balloon,
a plurality of the ballasts is disposed corresponding to each of discharge lamps, and
a plurality of power lines leading to each of the discharge lamps from each of the ballasts is collected as one cable, and a connector for connecting and separating the plurality of power lines is disposed halfway in the cable, and
the power supply circuit includes a power factor improving function part and an overcurrent suppressing function part.

3. The balloon-type illumination device according to claim 1, further comprising:
a plurality of switch parts, each of which is disposed in the balloon and configured to energize and cut off a corresponding one of the power lines leading to a corresponding one of the discharge lamps from a corresponding one of the ballasts; and
a plurality of sensor parts, each of which is disposed in the balloon and configured to sense a deflated state of the balloon, wherein
the power supply circuit includes a drive control part configured to cut off the corresponding switch part when the corresponding sensor part senses the deflated state of the balloon.

4. The balloon-type illumination device according to claim 3, wherein at least one of the sensor parts includes a contact sensor that detects contact with the balloon.

5. The balloon-type illumination device according to claim 4, wherein at least one of the sensor parts includes a temperature sensor that detects temperature in the balloon.

6. A projector including the balloon-type illumination device according to claim 1, the projector comprising:
a grounding part; and
a column part vertically supported to the grounding part, wherein
each of the ballasts is supported at the grounding part or a lower part of the column part, and
the balloon is supported at a top of the column part.

7. A projector including the balloon-type illumination device according to claim 3, the projector comprising:
a grounding part; and
a column part vertically supported to the grounding part, wherein
each of the ballasts is supported at the grounding part or a lower part of the column part, and
the balloon is supported at a top of the column part.

8. A projector including the balloon-type illumination device according to claim 4, the projector comprising:
a grounding part; and
a column part vertically supported to the grounding part, wherein
each of the ballasts is supported at the grounding part or a lower part of the column part, and
the balloon is supported at a top of the column part.

9. A projector including the balloon-type illumination device according to claim 5, the projector comprising:
a grounding part; and
a column part vertically supported to the grounding part, wherein
each of the ballasts is supported at the grounding part or a lower part of the column part, and
the balloon is supported at a top of the column part.

10. The balloon-type illumination device according to claim 2, further comprising:

a plurality of switch parts, each of which is disposed in the balloon and configured to energize and cut off a corresponding one of the power lines leading to a corresponding one of the discharge lamps from a corresponding one of the ballasts; and a plurality of sensor parts, each of which is disposed in the balloon and configured to sense a deflated state of the balloon, wherein the power supply circuit includes a drive control part configured to cut off the corresponding switch part when the corresponding sensor part senses the deflated state of the balloon.

11. The balloon-type illumination device according to claim 10, wherein at least one of the sensor parts includes a contact sensor that detects contact with the balloon.

12. The balloon-type illumination device according to claim 11, wherein at least one of the sensor parts includes a temperature sensor that detects temperature in the balloon.

13. A projector including the balloon-type illumination device according to claim 2, the projector comprising:

a grounding part; and a column part vertically supported to the grounding part, wherein each of the ballasts is supported at the grounding part or a lower part of the column part, and the balloon is supported at a top of the column part.

14. A projector including the balloon-type illumination device according to claim 10, the projector comprising:

a grounding part; and a column part vertically supported to the grounding part, wherein each of the ballasts is supported at the grounding part or a lower part of the column part, and the balloon is supported at a top of the column part.

15. A projector including the balloon-type illumination device according to claim 11, the projector comprising:

a grounding part; and a column part vertically supported to the grounding part, wherein each of the ballasts is supported at the grounding part or a lower part of the column part, and the balloon is supported at a top of the column part.

* * * * *